United States Patent [19]

Curwen

[11] Patent Number: 4,781,546

[45] Date of Patent: Nov. 1, 1988

[54] LINEAR RESONANT RECIPROCATING MACHINES

[75] Inventor: Peter W. Curwen, Ballston Spa, N.Y.

[73] Assignee: Mechanical Technology Incorporated, Latham, N.Y.

[21] Appl. No.: 24,258

[22] Filed: Mar. 10, 1987

[51] Int. Cl.[4] ..... F04B 31/00

[52] U.S. Cl. ..... 417/417; 123/46 R

[58]. Field of Search ..... 417/11, 340, 415, 416, 417/417; 92/9, 132, 133; 91/399; 123/46 R; 310/21, 29, 32; 267/170, 179, 166

[56] References Cited

U.S. PATENT DOCUMENTS

| | | | |
|---|---|---|---|
| 1,978,866 | 10/1934 | König | 417/417 |
| 2,925,073 | 2/1960 | Millar | 123/46 R |
| 3,169,757 | 2/1965 | Röder et al. | 267/170 X |
| 3,694,111 | 9/1972 | Braun | 123/46 R |
| 3,711,917 | 1/1973 | Baumgras | 267/166 X |
| 3,947,155 | 3/1976 | Bidol | 417/417 |
| 4,090,816 | 5/1978 | Takahashi | 417/417 X |

FOREIGN PATENT DOCUMENTS

| | | | |
|---|---|---|---|
| 0834125 | 7/1949 | Fed. Rep. of Germany | 417/417 |

*Primary Examiner*—Leonard E. Smith
*Assistant Examiner*—Szczecina, Jr. Eugene L.
*Attorney, Agent, or Firm*—Joseph V. Claeys; Joseph C. Sullivan

[57] ABSTRACT

A free-piston reciprocating compressor includes a reciprocating piston disposed within a cylinder such that one end of the piston-cylinder provides for a compression space and the other end of the piston-cylinder provides for a balancing space. The piston is coupled to and reciprocatingly driven by the armature of a linear electrodynamic motor, which armature reciprocates on guide means. The compressor also includes porting means operative to establish a stabilizing gradient sufficient to keep the piston operating at a related fixed mid-stroke position. The motor armature is also coupled to a centering-resonance spring.

4 Claims, 4 Drawing Sheets

10
104
100
102
106
98
18
28
28A
66
48
32
34
56
63
50
58
60
62
54
52
16
84
70
74
76
90

LINEAR RESONANT RECIPROCATING MACHINES

TECHNICAL FIELD

The present invention relates to free piston-type linear resonant reciprocating machines such as compressors, pumps and the like.

BACKGROUND ART

There exists a class of machinery which utilizes mechanical resonance as the means to obtain periodic motion of the machine elements. Reciprocating compressors of this class, often referred to as "resonant piston compressors," can be advantageously used in a variety of applications, such as for example, electrically-driven heat pump systems and the like.

In known free-piston resonant reciprocating compressors the fluid compressing member, such as a piston, is driven by a suitable motor, such as a linear reciprocating electrodynamic motor. A compression piston is usually coupled to the motor armature and the armature held in a rest position by way of one or more main or resonance springs. When the motor is energized, such as by an alternating current, a periodic magnetic force is generated to drive the piston. If the frequency of the periodic magnetic force is sufficiently close to the mechanical resonance frequency of the compressor (as determined essentially by the mass of the reciprocating assembly and the combined stiffness of all mechanical and gas spring components), the piston will oscillate back and forth to provide compression of the fluid.

U.S. Pat. Nos. 3,937,600 to White for a "Controlled Electrodynamic Linear Compressor" and 4,353,220 to Curwen for a "Resonant Piston Compressor Having Improved Stroke Control for Load-Following Electric Heat Pumps and the Like" relate to double-ended type, electrodynamic motor-driven reciprocating compressors including gas springs. In such double-ended two-compressor-cylinder arrangements, identical parallel flow cylinders are involved. In principal, these two cylinders would undergo the same compression cycle and would be subjected to the same pressure forces so that such double-ended design would (in theory) be intrinsically pressure balanced. In practicality, however, such designs are inherently unstable. As long as the two cylinders operate with the same value of mid-stroke volume (or equivalently, at the same clearance volume ratio) then the two cylinders will impose equal but oppositely-directed (cancelling) average pressure forces on the plunger-driven pistons. However, any slight offset bias of the plunger from the theoretical center position causes the average pressure forces on the two pistons to be unbalanced in such a way that it tends to push the plunger further off center, resulting in an axially unstable arrangement. To solve such a situation, these patents introduce ports on the gas springs. When the piston begins to go off center, an opposing average pressure force which is larger than the destabilizing force coming from the cylinder would be generated resulting in a stable operating center position.

While such an arrangement has proved eminently satisfactory in the two-compressor-cylinder arrangement, axial positioning stability in a single cylinder arrangement is also desired.

DISCLOSURE OF INVENTION

It is an object of this invention to provide for an improved reciprocating compressor which has a controlled and efficient operating stroke.

It is another object of this invention to provide for axial positioning stability in a linear motor-driven reciprocating compressor especially when only a single compression piston is involved.

It is still another object of this invention to provide a spring assembly for a reciprocating compressor that avoids stress concentrations that may lead to early failure.

The present invention provides for an improved electrodynamic linear-motor-driven reciprocating machine, such as a compressor, pump, or the like. Although any suitable reciprocating motor may be used, it is preferred to employ an electrodynamic linear motor of the type described in U.S. patent application, Ser. No. 024,242, 3-10-87, filed concurrently with this application and entitled, "Flat Plunger Linear Electrodynamic Machine", in the name of Peter W. Curwen and Ralph Hurst, and assigned to Mechanical Technology Incorporated, the same assignee as the present invention.

The electrodynamic motor of that application has a lightweight flat plunger which significantly reduces the amount of resonance spring required. The plunger assembly is formed from alternate layers of magnetic and insulating strips clamped together with suitable tie rods and maintained on respective guide shafts which reciprocate on guide members within the gap between stator members. One end of the motor plunger is coupled to a compression piston and a centering or resonance spring may be provided at the opposote end. Depending on the application and the magnitude of the centering force provided by the motor, sometimes such centering spring may not be necessary.

Positioned about and spaced from the plunger core is a motor stator assembly which is mounted to the housing. The application of current to the stator windings causes a driving force on the plunger core which in turn drives the piston for compression of the working fluid. Porting means are provided to maintain centered operation of the piston stroke with the stator assembly.

BRIEF DESCRIPTION OF THE DRAWINGS

The aforenoted objects and advantages and others will be realized by the present invention, the description of which should be taken in conjunction with the drawings wherein.

BEST MODE FOR CARRYING OUT THE INVENTION

Figure 2:
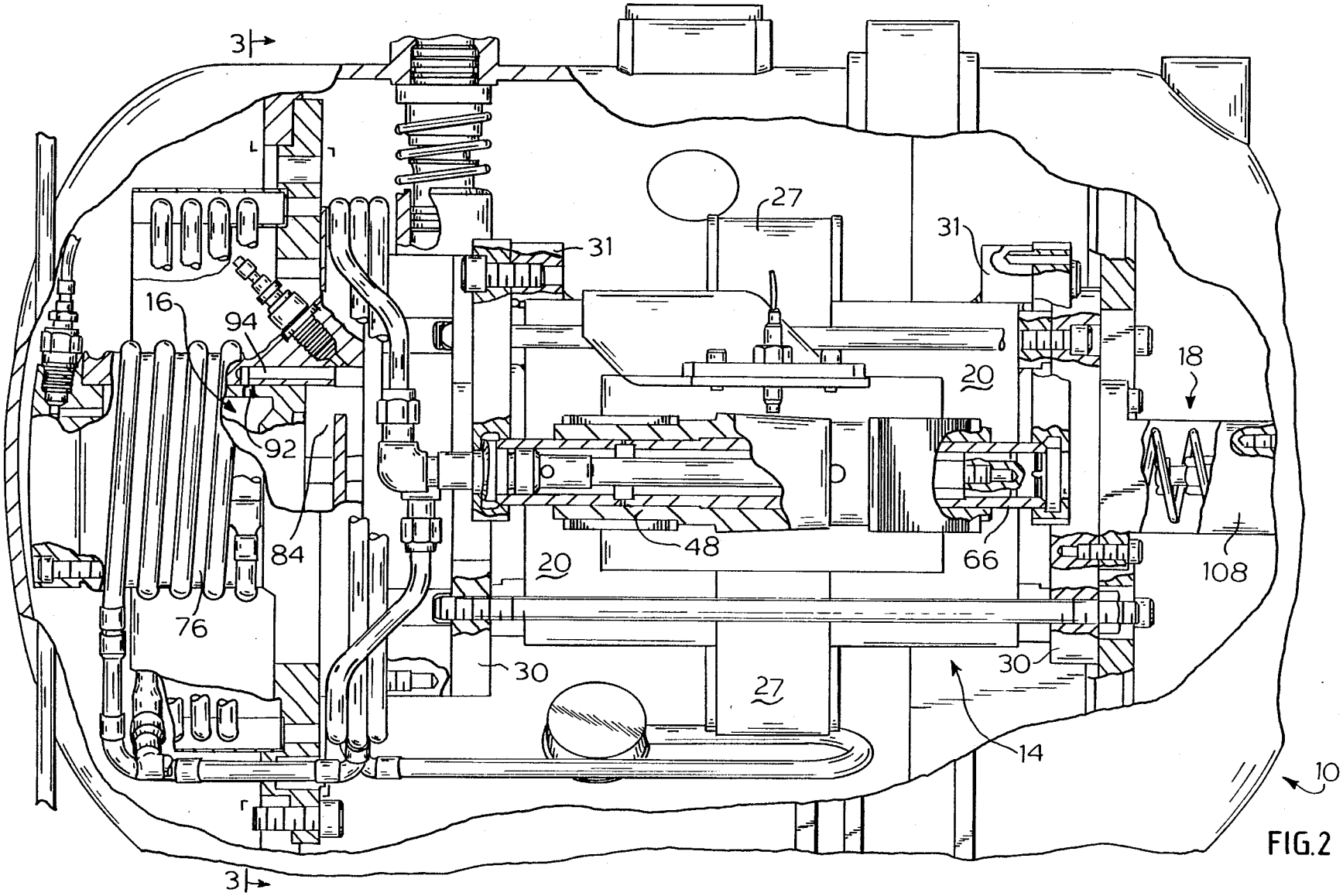
FIG. 2 is another detailed, partial sectional side view of the reciprocating compressor incorporating the teachings of the present invention.
Figure 4:
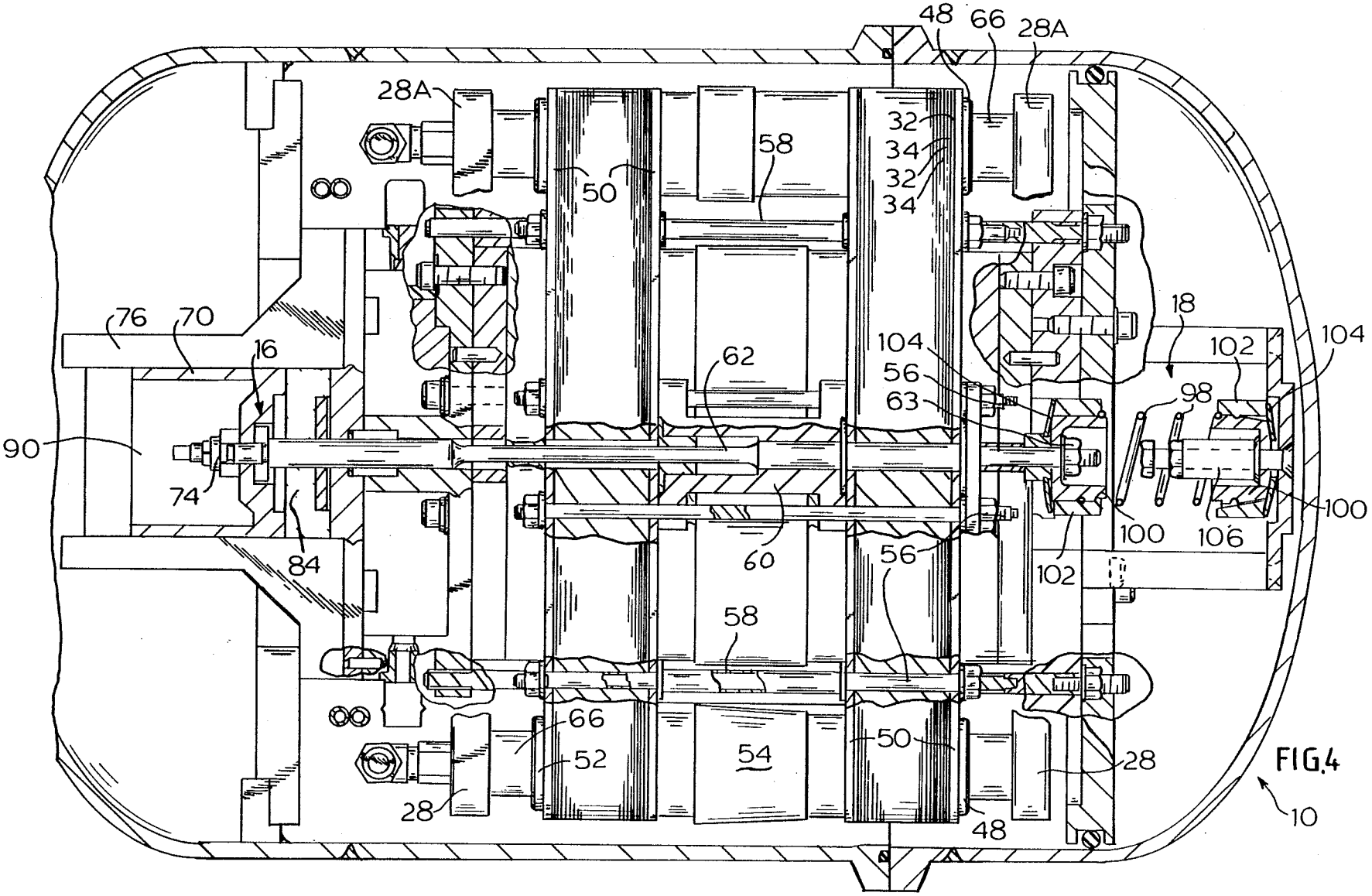
FIG. 4 is a detailed, partial sectional side view taken along lines 4—4 of FIG. 3.

With more particular regard to the drawings, there is shown a compressor 10. The compressor 10 includes an outer housing 12 which is cylindrical in shape containing a flat type electrodynamic motor, generally indicated at 14 coupled to a compression piston assembly 16. A centering spring assembly 18, shown more clearly in FIGS. 2 and 4, is provided at the opposite end of the motor. In operation when an alternating current is applied to the motor its magnetic plunger is caused to drive the compression piston in a first direction compressing the working fluid (such as air, helium, etc.). The current then alternates so that the plunger oscillates and returns to its center position due to the reversed driving force by the stator, and/or the centering spring assembly 18 and/or any incorporated gas spring means. The motor operates typically at the frequency of the local A-C power source (on the order of 60 Hertz in the U.S. and 50 Hertz in some foreign countries) continuously compressing the working fluid.

Figure 1:
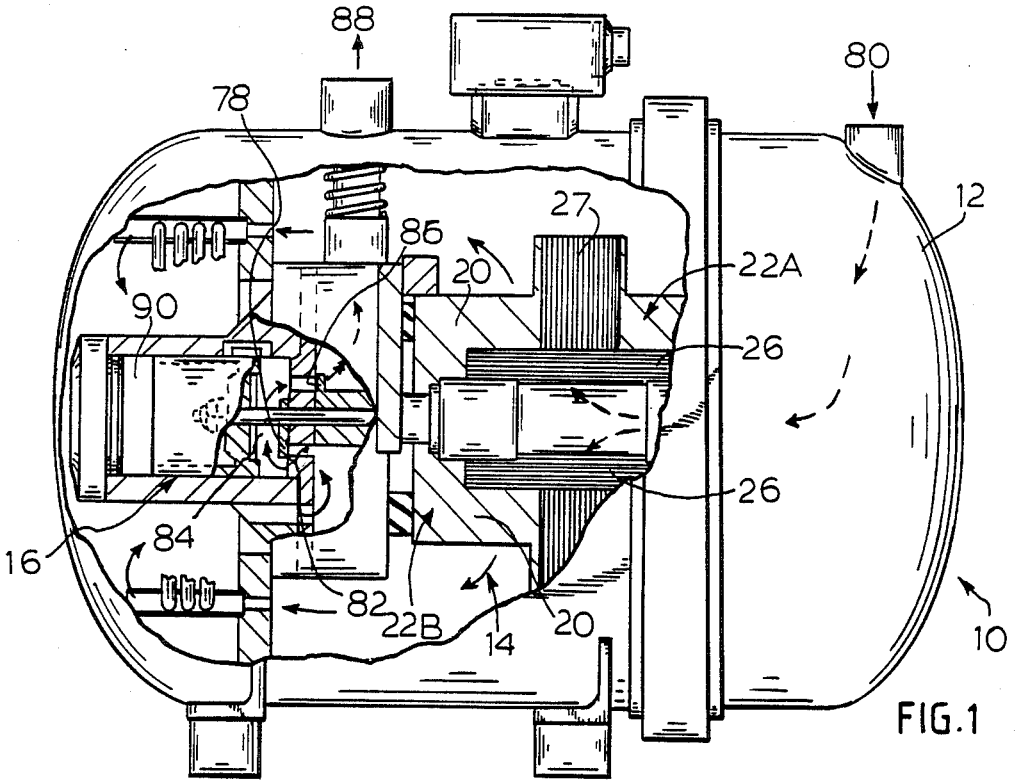
FIG. 1 is a partial sectional side view of a reciprocating compressor in accordance with the teachings of the present invention.
Figure 3:
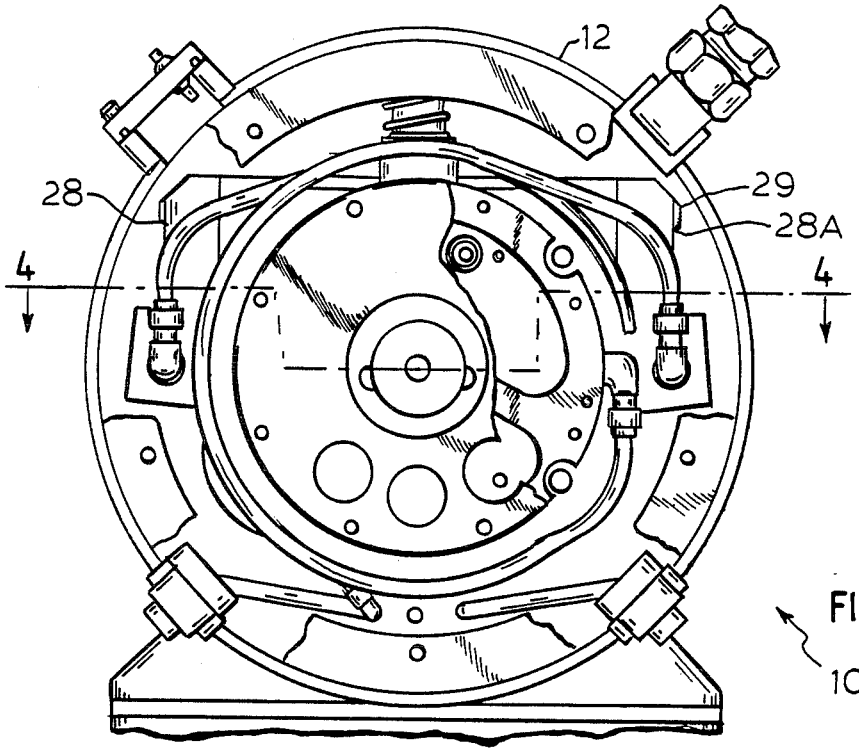
FIG. 3 is a front, partial sectional view taken along line 3—3 of FIG. 2.

As shown more clearly in FIG. 4, piston assembly 16 comprises a hollow cylindrical piston member 70 having a closed end 72 which is mechanically affixed at 74 to one end of rod 62, which in turn is connected to the armature of motor 14. The piston member 70 is positioned in a cylindrical cylinder housing 76 which includes suction valve means 78 for receiving the working gas. The working gas enters the housing at opening 80 and passes through the housing in the direction shown by the arrows in FIG. 1. The gas enters channel or port 82 and passes through suction valve 78 into compression chamber 84 where it is compressed and exits via discharge valve 86 and outlet 88. As illustrated, the compression stroke is to the right, but can be in either direction.

The piston member 70 is a reciprocating piston which compresses on both sides of its face so that on the opposite side of the compression space there is a closed volume or balance chamber 90. Since in certain applications there may be no counteracting force on the piston such as that usually provided by the spring assembly 18, a suitable means is provided for balancing the average pressure forces on each face of the piston member 70. To this end, a port 92 is provided in the wall of piston member 70. Also, a slot or channel 94 which communicates with the compression space 84 is provided in the cylinder wall. Each time the piston member 70 reciprocates through or near its mid-stroke position the port 92 is communicating with the channel 94 and in turn the compression space 84. The instantaneous pressures in the balance chamber 90 and the compression chamber 84 are not normally balanced at the instant when port 92 is communicating these two chambers with each other. Port 92 and channel 94 serve to provide a means for balancing the pressure forces on each face of the piston when the pressure forces are averaged over a complete reciprocation cycle and, in addition, provides a stabilizing force gradient.

Figure 5:
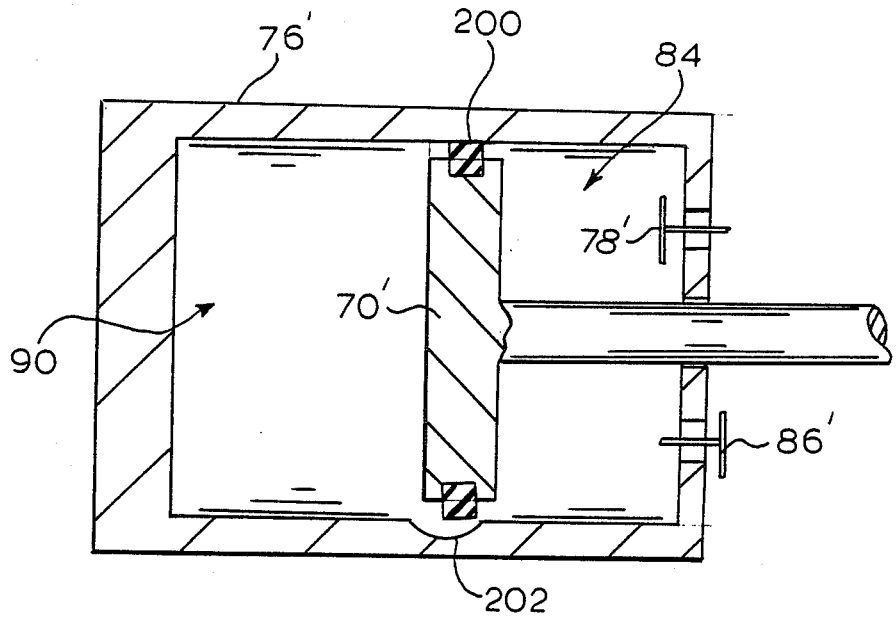
FIG. 5 is a schematic view of the piston-cylinder portion of another embodiment of the reciprocating compressor in accordance with the teachings of the present invention.

In FIG. 5, there is schematically illustrated another suitable means for balancing the average pressure forces on each face of the piston. As shown, a piston member 70' is disposed within cylinder housing means 76' which includes suction valve means 78' and discharge valve means 86'. Piston member 70' is provided with a suitable sealing ring means 200. One face of piston member 70' defines a compression space or chamber 84 and the other face of piston member 70' defines a balance space or chamber 90. The cylinder wall is provided with at least one porting slot 202, preferably disposed at or near the mid-stroke position.

The operation of the foregoing means for balancing the average pressure forces on each face of the piston is similar to that already described with respect to the piston port and cylinder wall slot. For example, each time the piston member 70' reciprocates through or near its mid-stroke position the compression chamber 84 and balance chamber 90 are in communication through the space provided between the sealing ring means 200 and the porting slot 202. This space thus provides a means for balancing the pressure forces on each face of the piston when the pressure forces are averaged over a complete reciprocation cycle and, in addition, provides a stabilizing force gradient.

The foregoing described arrangements eliminate the need for using mechanical springs for resonance purposes and stabilization. The foregoing porting allows for an equal average pressure on both sides of the piston (i.e., time averaged) and enables the balancing and stabilizing space 90 to develop a stabilizing gradient sufficient to keep the piston operating at a reasonably fixed mid-stroke position. Such a space also provides for dynamic stiffness which serves to resonantly tune the device which is adjustable by adjusting the balancing chamber volume to achieve the desired dynamic tuning stiffness.

As aforenoted, the electromagnetic forces of the motor tends to cause the plunger assembly to center itself. If desired, however, depending upon the particular application, a spring assembly 18 may be utilized for centering and resonance purposes where applicable. In this regard and as shown most clearly in FIG. 4, the plunger assembly of motor 14 is mechanically affixed to the spring assembly 18. The spring assembly 18 is intended to utilize a helical high strength steel coil spring 98.

It was found that when a helical spring is subject to high frequency oscillating displacement (i.e., 60 Hertz), early fatigue failure is a problem. If the dynamic deflection range is small (of the order ½ inch or less), it is generally possible to use a conventional helical compression spring wherein the spring is preloaded between two plates. This results in the situation that the spring will always be in a state of compression as the relative displacements of the end plates subject the spring to the high frequency oscillatory deflection. Preloaded compression spring arrangements are shown, for example, in U.S. Pat. Nos. 3,814,550 and 3,788,778. In preloaded compression spring arrangements there is no means required for mechanically gripping or clamping the ends of the spring coil. However, such an arrangement cannot, by its nature, transmit tensile loading to a helical spring. Thus, if it is desired to subject a helical spring to tensile displacements, the preloaded compression spring arrangement is not sufficient.

As noted, helical compression springs should be limited to dynamic deflection ranges of ½ inch or less (for high strength steel springs) if very long operating life is required at 60 Hertz. For any given spring material and operating frequency the dynamic deflection range will vary. However, if a helical spring is used as a tension-compression spring, such that one-half of the dynamic deflection range is achieved by compressive deflection and the other half by tensile deflection, the dynamic deflection range of the spring can be extended to approximately 1 inch. To achieve this extended deflection range, means must be provided for gripping the ends of the spring coil in such a way that (1) tensile deflections can be imparted to the spring, and (2) stress concentration effects arising from the gripping means are small.

The gripping arrangement for the helical spring assembly 18 (FIG. 4) attempts to simulate to a certain degree the method of stress transition which exits in a compression-only spring. With this gripping method, the spring can be operated as a tension-compression spring.

In this arrangement, the helical spring 98 is "threaded" onto a suitably machined mandrel block 100. The outside diameter of the spring is ground with a taper which matches the internal diameter taper of a clamping collar 102. The collar 102 is axially loaded against the ground outer diameter of the spring 98 by a suitable loading means such as, for example, a Belleville washer 104.

With this arrangement, there will be a differential strain between the surface of the stressed spring 98 and the essentially unstressed surface of the mandrel 100 against which the spring is seated. This differential strain is greatest at the point where the coil enters the mandrel thread and may result in surface fretting (wear) of the spring 98.

To alleviate the fretting wear problem, the spring 98 and/or the mandrel block 100 should be dip-coated in epoxy (or other low modulus material) to form a thin, low-modulus coating which can absorb the differential strains.

The opposite end of the spring is similarly affixed with the exception that the mandrel, collar and washer are held in place by way of a mounting bolt 106 axially centered with respect to the spring 98 mounting it to perhaps a spring assembly housing 108.

Although only certain specific embodiments of the invention have been described in detail herein with reference where suitable to the accompanying drawing, it is to be understood that the invention is not limited to those specific embodiments and that various changes and modifications will occur to and be made by those skilled in the art. The appended claims, therefore, are intended to cover all such changes and modifications as fall within the true spirit and scope of the invention.

What is claimed is:

1. A free-piston reciprocating compressor, comprising:

a cylinder having suction and discharge valve means operatively associated therewith;

a piston means disposed for reciprocal movement within said cylinder and defining at one end a valved compression chamber and at the other end a closed volume balance chamber;

means for reciprocally driving said piston means in said cylinder for compressing a working fluid; and porting means operatively associated with said piston-cylinder for balancing the time-average pressure forces on both sides of said piston means and providing a stabilizing force gradient wherein said piston means includes a hollow piston member having a port disposed in the wall thereof which during some portion of the reciprocation cycle communicates with a passage disposed in the wall of said cylinder, said passage during said some portion of the reciprocation cycle providing communication between said valved compression chamber and said closed volume balance chamber.

2. The reciprocating compressor in accordance with claim 1, wherein the communication between said piston wall port and said cylinder wall channel takes place at or near the mid-stroke position of said piston means.

3. A free-piston reciprocating compressor for use in association with a reciprocal motor, said arrangement comprising:

a piston;

a cylinder for receiving said piston;

means for reciprocally moving said piston within said cylinder;

a balance chamber comprising a closed volume defined by a first side of the piston and the cylinder;

a valved compression chamber for compressing a working fluid defined by a second side of the piston and the cylinder;

porting means capable of allowing communication between said balance chamber and said valved compression chamber during some portion of the cycle of reciprocation of the piston in the cylinder, said port means allowing for a balancing of the time-averaged pressure forces on both sides of the piston;

wherein an offset movement of the piston in one direction created an unbalanced average pressure force pushing the piston in the opposite direction and developing a stabilizing gradient; and wherein said porting means includes a fixed opening in the wall of said piston and a channel in said cylinder in which when aligned allows a communication of the chambers on both sides of the piston.

4. The reciprocating compressor in accordance with claim 3, wherein said piston wall port and said cylinder wall channel are aligned at or near the mid-stroke position of said piston.

* * * * *